United States Patent [19]

Loebach

[11] 4,373,713

[45] Feb. 15, 1983

[54] DIVERTER MECHANISM

[75] Inventor: Michael H. Loebach, Red Lion, Pa.

[73] Assignee: Motter Printing Press Co., York, Pa.

[21] Appl. No.: 219,829

[22] Filed: Dec. 24, 1980

[51] Int. Cl.[3] ..... B65H 29/60; B65H 29/68

[52] U.S. Cl. ..... 271/303; 83/105; 83/107; 271/182; 271/302

[58] Field of Search ..... 271/279, 303, 302, 304, 271/305, 182; 198/441, 442, 440; 83/107, 105, 106, 102

[56] References Cited

U.S. PATENT DOCUMENTS

| | | | |
|---|---|---|---|
| 2,164,436 | 7/1939 | Waters | 271/303 X |
| 3,218,897 | 11/1965 | Geigenmiller et al. | 83/106 X |
| 3,391,777 | 7/1968 | Joa | 271/303 X |
| 3,565,423 | 2/1971 | Kluth | 271/303 X |

FOREIGN PATENT DOCUMENTS

| | | | |
|---|---|---|---|
| 2200260 | 8/1972 | Fed. Rep. of Germany . | |
| 2609136 | 9/1976 | Fed. Rep. of Germany | 271/303 |
| 1208969 | 10/1970 | United Kingdom | 271/303 |
| 1541562 | 3/1979 | United Kingdom . | |

*Primary Examiner*—Bruce H. Stoner, Jr.
*Attorney, Agent, or Firm*—Brumbaugh, Graves, Donohue & Raymond

[57] ABSTRACT

A sheet diverter in the path of a stream of cut sheets to be diverted in predetermined sequence in different directions in which a pair of rotary diverters having cam surfaces thereon divert and guide the sheets in the predetermined sequence relative to a pair of guiding surfaces.

5 Claims, 8 Drawing Figures

DIVERTER MECHANISM

This invention relates to a sheet diverting system for diverting sheets in a predetermined sequence to different downstream stations.

Although the sheet diverting system of the present invention has a more general application for use in sheet handling systems, it is particularly applicable for use in printing presses in which webs are printed and folded into ribbons, and the ribbons are cut into folded sheets or signatures. In conventional printing presses, a number of pages are printed by the printing cylinder so that there are a number of different signatures in the stream emerging from the cutter between repeat signatures. The delivery section of the printing press usually separates like signatures and directs them to different conveyors in stacked or overlapping fashion which serve as collection stations for repeat signatures. The signatures are then usually delivered to an inserter for assembling and stitching them in a book.

The conventional delivery section of a printing press includes a plurality of transfer cylinders which utilizes grippers or pins to engage the signatures and direct them along appropriate paths of travel to the proper collection stations. These grippers and pins are controlled by actuating means operated in timed relation with the travel of the signatures and, more particularly, the leading edges thereof, to insure proper handling. The criticality of actuating the pins and grippers in timed relation to the sheets imposes speed limitations on the handling of the signatures in the delivery section of the printing press. These speed limitations, in turn, impose speed limitations on the printing press itself, unless the delivery section is isolated from the printing press, rather than an in-line section of the printing press.

The sheet diverter of the present invention includes a pair of rotary diverters through which the cut signatures pass in a stream, guide means on the downstream side of the rotary diverters having at least a pair of guide surfaces to direct the signatures in different directions, and raised sheet diverter means carried by both rotary diverters and spaced in relation to each other so that they engage and divert the signatures in a predetermined sequence to the appropriate guiding surfaces of the guide means. The signatures thus diverted are carried in separate streams to downstream stations which may include additional sheet diverters or collection stations.

The sheet diverter of the present invention does not embody means for gripping, engaging or piercing the leading edges of the signatures, and accordingly it is capable of higher speed operation than a conventional transfer cylinder. Since there is no gripping, engaging or piercing of the signatures, there is no problem of damage to the signatures from such actions. On the contrary, the sheet diverter of the present invention acts not only to deflect the leading end of a signature in the desired path of travel but, in addition, to guide and support the signature throughout a substantial portion of its length, between a pair of surfaces both moving in the same direction as the sheet. The sheet diverter of the present invention, therefore, is a substantial improvement over the conventional pin and gripper transfer cylinders utilized in a conventional delivery section of a printing press.

These and other advantages of the present invention will be more fully understood from the detailed description which follows and by reference to the accompanying drawings in which.

Figure 1:
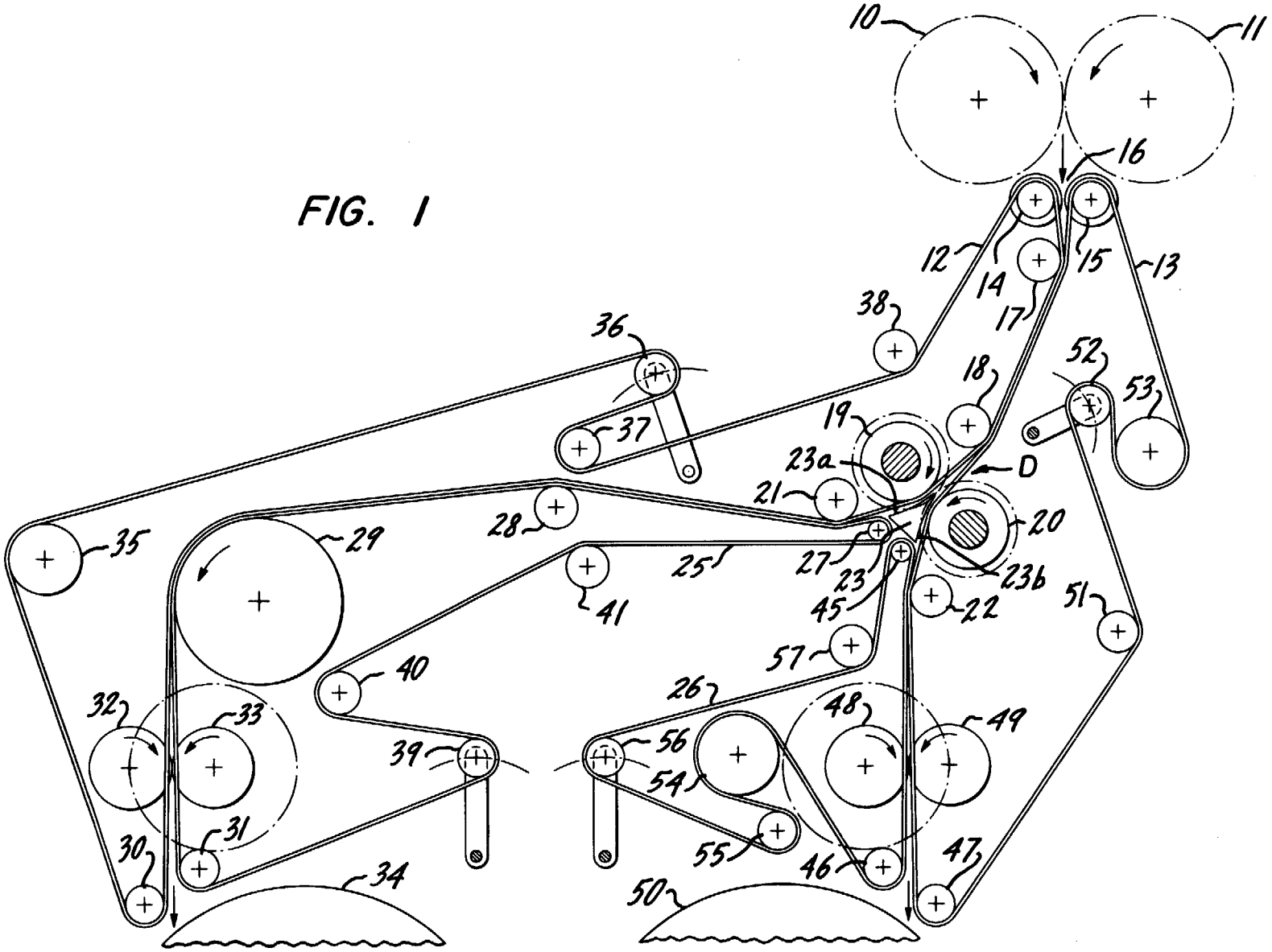
FIG. 1 is a schematic side elevational view of a sheet diverting system embodying the present invention.
Figure 2:
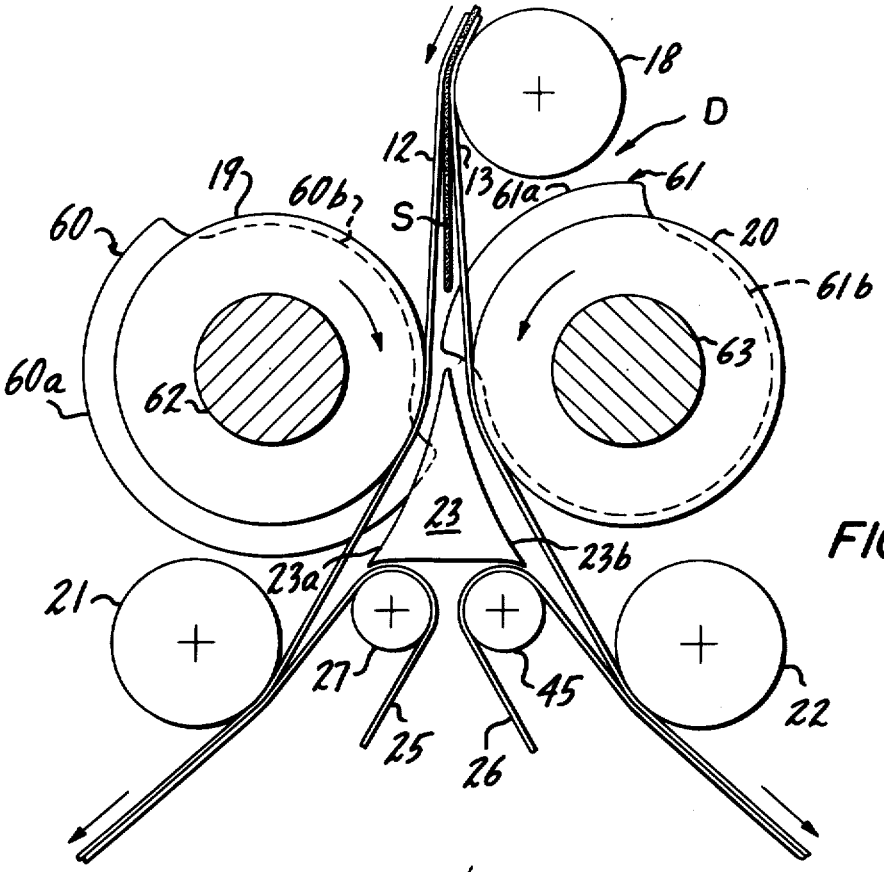
FIGS. 2, 3, 4, 5 and 6 are enlarged side elevational views of a sheet diverter embodying the present invention showing the operation of an embodiment of the invention in which successive sheets are diverted in one direction and then a succeeding sheet is diverted in another direction.
Figure 3:
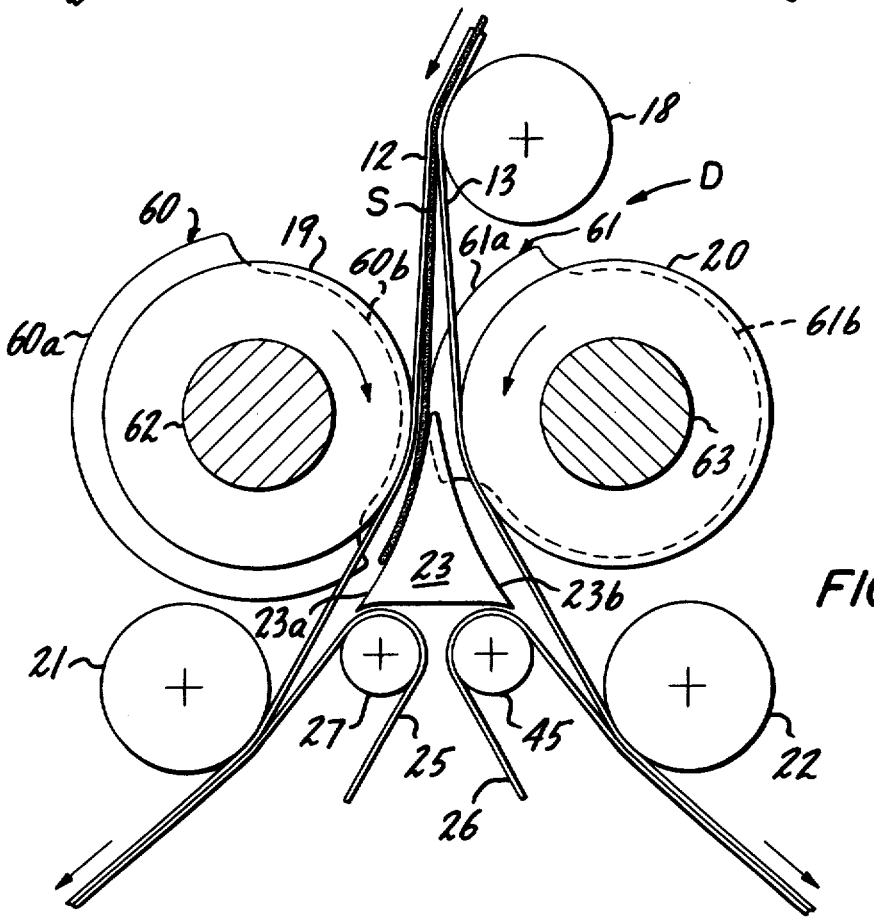
Figure 4:
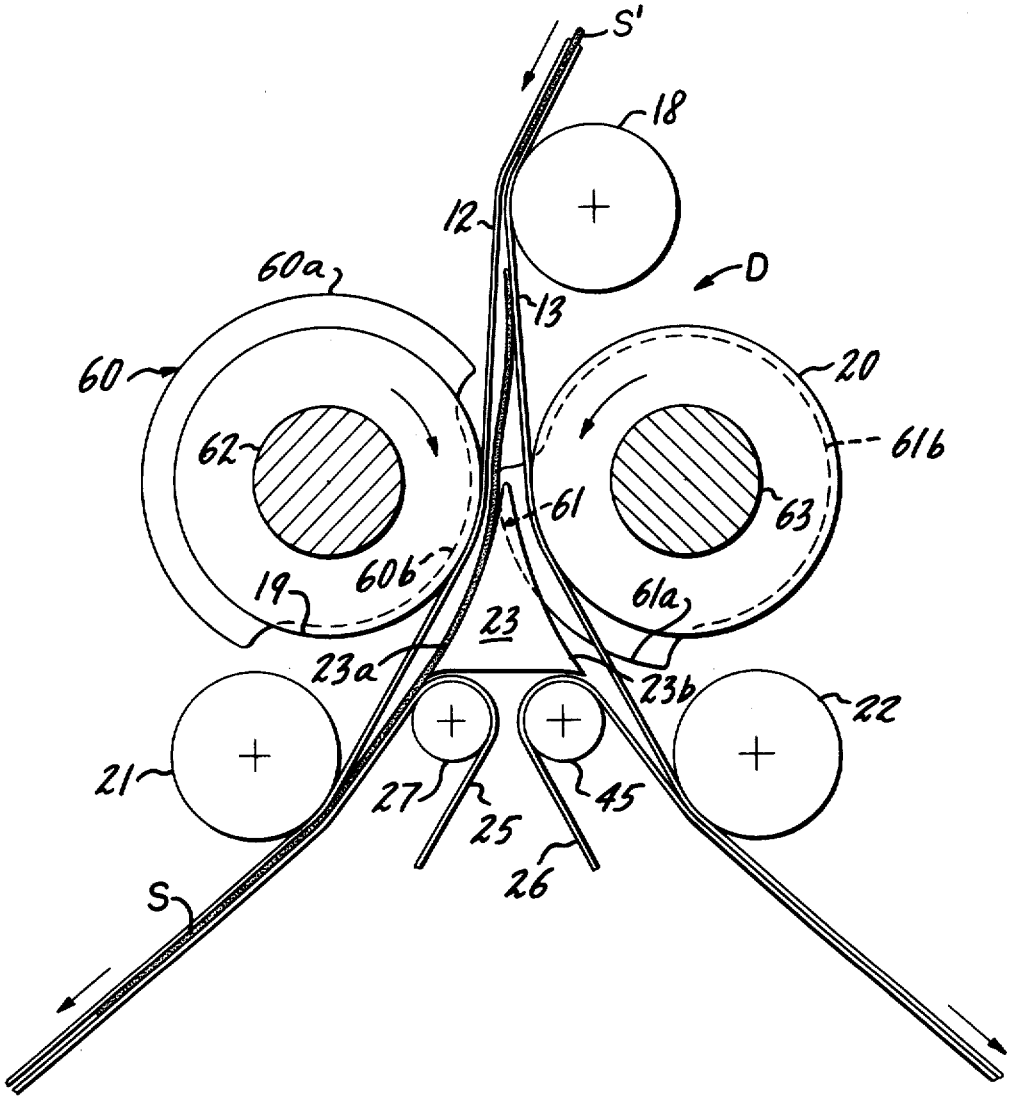

The sheet diverter of the present invention shown in FIG. 1 of the drawings is part of the delivery section of a printing press in which webs are printed, folded into ribbons, and the ribbons are directed between a pair of rotary cutting cylinders 10 and 11 which cut the ribbons into folded sheets or signatures. The folded and cut sheets or signatures, referred to herein generically as sheets, provide the insert pages for a book. Successive sheets printed from different plates are directed to different collection stations where similarly printed sheets are collected. These successive sheets, therefore, must be directed along different paths of flow to their respective collection stations. The sheet diverter system shown in FIG. 1 embodies a sheet diverter D which diverts successive sheets alternately toward a pair of collection stations, but it should be understood that each of the two sheet streams separated by the sheet diverter can, in turn, be divided by additional sheet diverters so that the initial stream of cut sheets can be diverted to as many collection stations as are required.

The initial stream of cut sheets to be diverted in a predetermined sequence to different collection stations is discharged from the pair of rotary cylinders 10, 11 and carried between a pair of sheet feeding tapes 12, 13, each guided in a closed path, to the sheet diverter D. Toward this end, directly downstream of the cutting cylinders, the tapes 12, 13 are guided by a pair of rolls or pulleys 14, 15 in converging paths to form a gap 16 for receiving the cut sheets therebetween. The tapes 12, 13 are then guided by rolls 17, 18 in side-by-side paths to carry the stream of cut sheets to the sheet diverter D where the cut sheets are alternately diverted in different directions and fed to different collection stations.

Downstream of the roller 18, the tapes 12, 13 are guided along diverging paths by the guide rolls or wheels 19, 20 associated with the sheet diverter D which will be described in more detail below. The tape 12 is guided along one path by the rotary guide rolls 19 and 21, and the tape 13 is guided along another path by the rotary guide rolls 20 and 22. A tapered guide 23 having a pair of diverging guide surfaces **23*a*, 23*b* has its upstream tapered end interposed between the diverging tapes 12, 13 just downstream of the rotary diverter D, and the cut sheets are diverted in a predetermined sequence toward the guiding surfaces 23*a* or 23*b*. Cut sheets diverted in one direction pass between the surface 23*a* and the tape 12, and cut sheets diverted in the opposite direction pass between the surface 23*b* and the tape 13**.

Downstream of the guide 23 another tape 25 guided in a closed path cooperates with the tape 12 to feed the sheets discharged from the guide surface **23*a* towards a downstream station, and a tape 26 guided in a closed path cooperates with the tape 13 to feed the sheets discharged from the guide surface 23b towards another downstream station. The downstream stations can be additional sheet diverters which divide each stream into a pair of streams or collection stations, as desired. In the system shown in FIG. 1**, the downstream stations are conventional collection stations.

The tape 25 is guided by a roller 27 along a converging path with the tape 12 to form a gap for receiving sheets therebetween. The tapes 12, 25 are then guided along side-by-side paths by guide rolls 28 and 29 to carry the sheets therebetween. Downstream of the guide roll 29, the tapes 12, 25 are guided along diverging paths by guide rolls 30, 31, releasing the sheets and introducing them between a pair of conventional slow-down rolls 32, 33 which reduce the speed of travel of the sheets and feed them onto a rotary fan wheel 34 which discharges them onto a conveyor (not shown). The tape 12 is then directed by a guide roll 35, a spring-urged take-up or tensioning roll 36 and guide rolls 37, 38 back to the guide roll or pulley 14 to complete the closed path of the tape. The tape 25 is guided by a spring-urged tensioning roll 39 and guide rolls 40, 41 back to the guide roll 27 to complete its closed path of operation.

The other stream of cut sheets is transported from the sheet diverter D in similar fashion to a collection station. Toward this end, the tape 26 is guided by a guide roll 45 along a converging path with the tape 13 to form a gap downstream of the guide surface 23b for receiving the sheets therebetween. The tapes 13, 26 are then guided along side-by-side paths around a portion of the guide roll 22. Downstream of the guide roll 22, the tapes are separated along diverging paths by the guide rolls 46 and 47, thereby releasing the sheets and feeding them between a pair of slow-down rolls 48, 49 which reduce the speed of travel of the sheets and discharge them onto a fan wheel 50 for delivery to a conveyor belt (not shown). The tape 13 is then returned to the guide roll or pulley 15 by a guide roll 51, a spring-urged tensioning roll 52 and a guide roll 53, and the tape 26 is returned to the guide roll 45 by guide rolls 54, 55, spring-urged tensioning roll 56 and a guide roll 57.

The structure and operation of the sheet diverter D can be more readily understood by reference to FIGS. 2 through 7 which illustrate the operation of two embodiments of the sheet diverter of the present invention. In the sheet diverter illustrated in FIGS. 2 through 6, two successive sheets are diverted in one direction and one sheet is diverted in the other direction during each cycle of operation. In the embodiment shown in FIG. 7, alternate sheets are diverted in different directions. It should be understood that the sheet diverter of the present invention can be designed to divert the sheets in any desired sequence.

Turning to the embodiment illustrated in FIGS. 2 through 6, the sheet diverter D includes a pair of rotary sheet diverters 60, 61 mounted on parallel driven shafts 62, 63, respectively. The rotary sheet diverters 60, 61 carry raised sheet diverting cam portions 60a, 61a, respectively, and recessed portions 60b and 61b, respectively.

Figure 5:
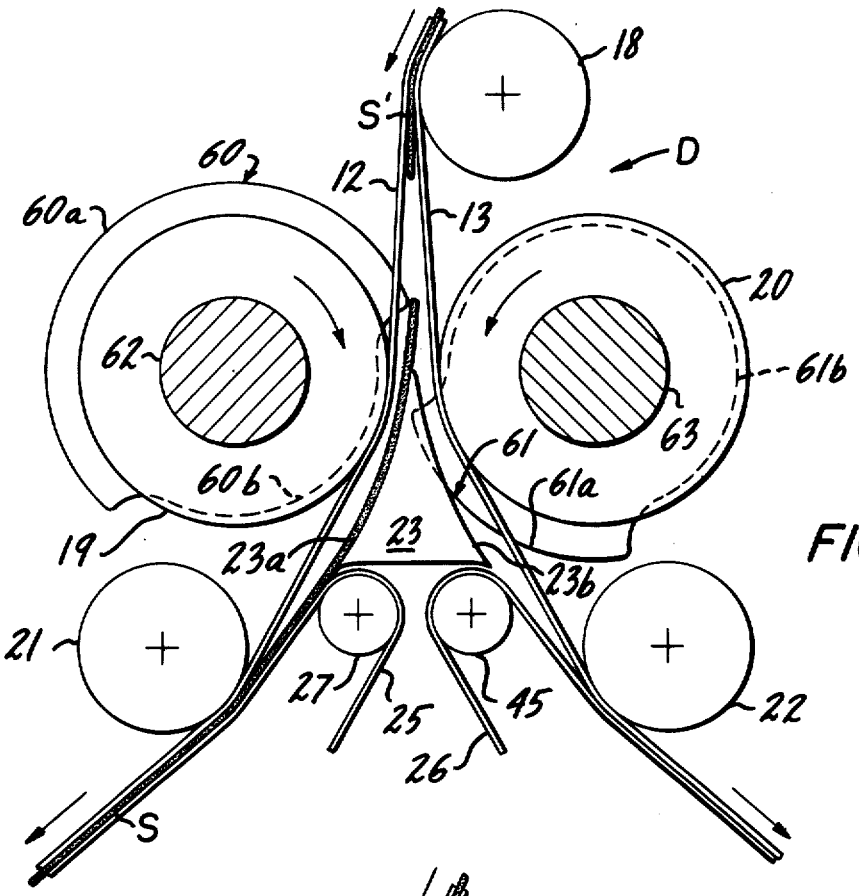
Figure 6:
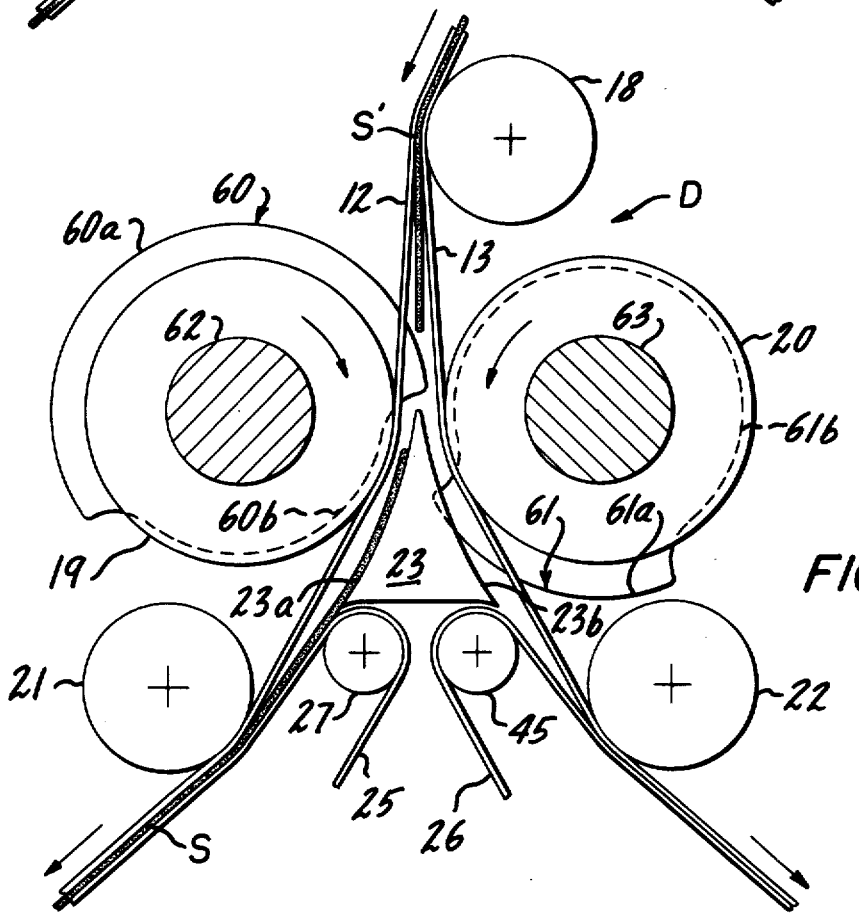

In the sequence of steps illustrated in FIGS. 2 through 6 of the drawings, a sheet S is fed by the tapes 12, 13 between the rotary sheet diverters 60, 61, and the sheet is diverted by the raised cam portion 61a of the rotary sheet diverter 61 into the flow path defined between the guide surface 23a and the tape 12. They direct the sheet into the sheet receiving gap formed by the tapes 12, 25 which carry the sheet to the downstream station. As the next sheet S' is introduced between the rotary sheet diverter, as shown in FIGS. 5 and 6, the raised sheet diverting cam 61a has been rotated out of the path of the sheet S' and the raised sheet diverting cam 60a of the rotary diverter 60 is interposed in the path of the sheet S' to divert it into the flow path defined between the guide surface 23b and the tape 13. They, in turn, divert the sheet to the gap formed between the tapes 13, 26 which carry the sheet S' to a different downstream station. Because of the extended length of the sheet diverting cam 60a, it will divert the succeeding sheet along the same path of travel as the preceeding sheet S'. As a succeeding sheet is fed into the sheet diverter D, the raised cam surface 60a will have been rotated out of the path of the sheet and the cam surface 61a will have been returned into the path of travel of the sheet to repeat the sequence.

Figure 7:
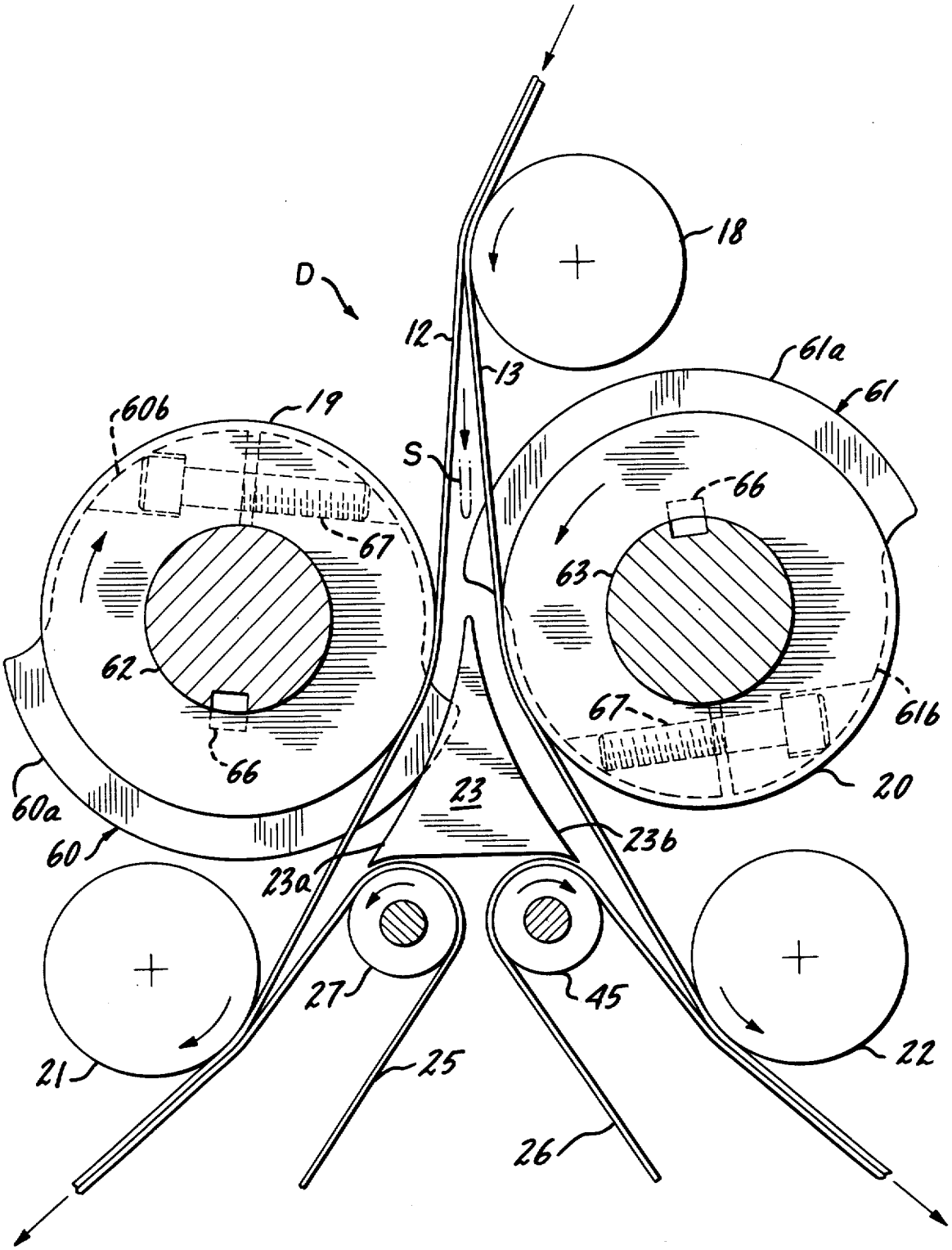
FIG. 7 is an enlarged side elevational view showing a modified embodiment of the sheet diverter shown in FIGS. 2 to 6 in which successive sheets are diverted in different directions.

In the embodiment illustrated in FIG. 7, the raised cam portions 60a, 61a are of approximately equal length and are introduced alternately into the path of travel of the sheet so that they divert successive sheets in different directions.

The raised cam portions 60a, 61a preferably extend circumferentially so that they not only engage and divert the leading edge of the sheet toward the desired path of travel, but they cooperate with the respective moving tapes 12, 13 to provide moving guiding surfaces on opposite sides of the sheets which will afford guidance and support to the sheets throughout a substantial portion of the length of the sheet from the leading to the trailing edges thereof. By thus guiding and supporting the sheet throughout a substantial portion of its length, there can be no tendency for the trailing end of the sheet to whip or be damaged or to enter the wrong path of travel through the diverter.

Although the arcs of the raised cam surfaces are not critical, in one preferred design of the embodiment illustrated in FIGS. 2 through 6 the raised cam 60a extended 210° around the outer periphery of the sheet diverter 60, the raised cam 61a of the sheet diverter 61 extended 90° around the outer periphery of the sheet diverter 61 and 30° gaps were provided between the trailing end of one cam surface and the leading end of the other. In a preferred design of the embodiment illustrated in FIG. 7, the raised cam surfaces 60a, 61a were each extended through arcs of 150° with 30° gaps between the trailing end of one and the leading end of the other.

Figure 8:
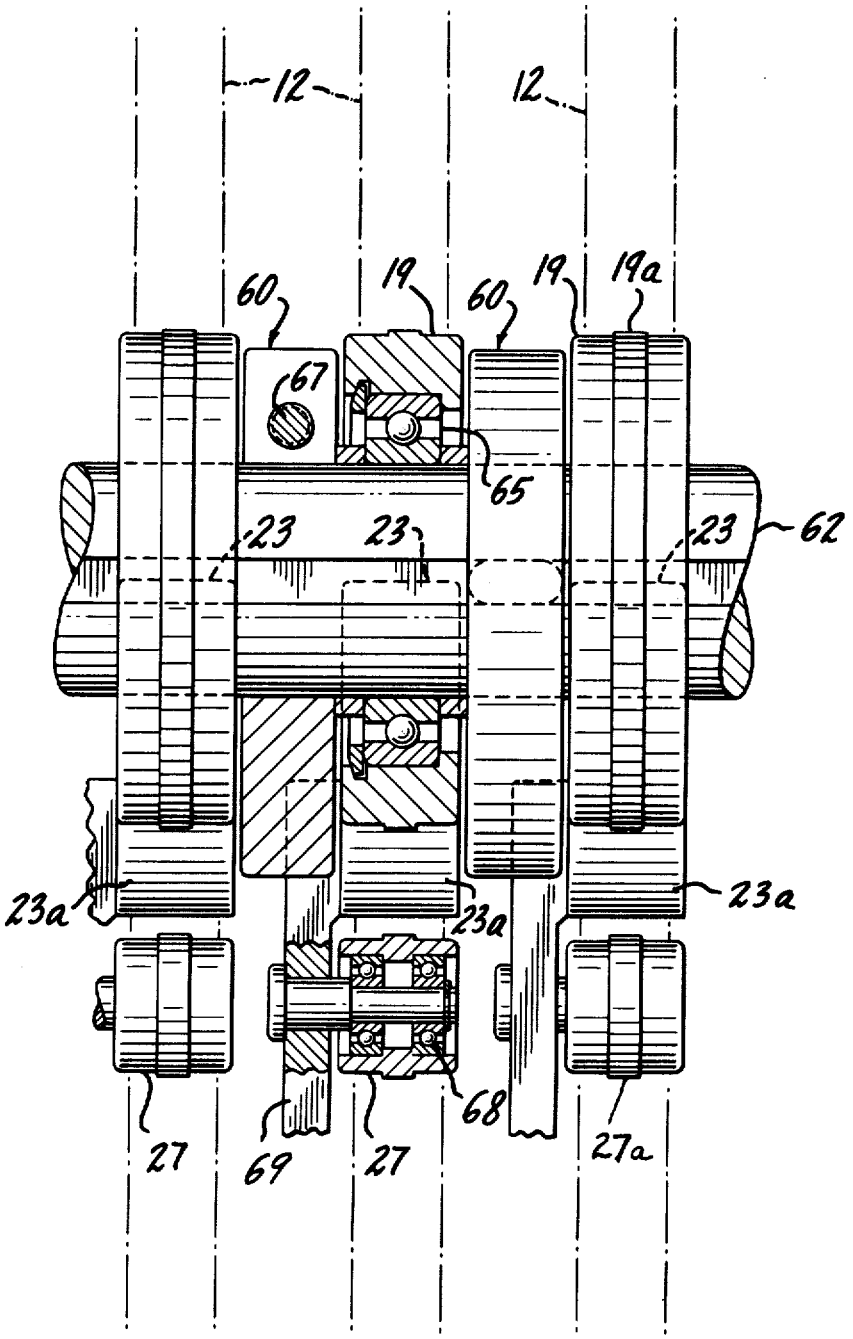
FIG. 8 is a front elevational view of one of the rotary diverters of the sheet diverter of the present invention.

The sheet diverter 60 is shown in more detail in FIG. 8 of the drawings. As shown therein, a plurality of guide rolls 19 are freely mounted on the driven shaft 62 by bearings 65, and rotary sheet diverters 60 are arranged and locked on the driven shaft 62 intermediate the guide rolls 19. As shown in FIGS. 7 and 8, the sheet diverters 60, 61 are in the form of split discs locked on the respective shafts by splines 66, and the split discs are tightened on the shaft 62 by screws 67. The raised cam surfaces of the rotary sheet diverters intermesh with the guide 23 to permit the cam surfaces to guide the sheet past the upstream tapered end of the guide onto the guiding surface and then permit the cam surface to recess beneath the guiding surface away from the sheet. The guide rolls 19 have raised friction crowns 19a thereon which provide non-slip engagement with the tapes. The guide rolls 27, which also have raised friction crowns 27*a* thereon, are rotably mounted on bearings 68 carried by a support 69.

The rotary sheet diverter 61 is identical to the rotary sheet diverter 60. The shafts 62, 63 are geared together and are driven by a common drive source (not shown).

The invention has been described in preferred forms and by way of example only, and many modifications and variations may be made therein within the spirit of the invention. The invention, therefore, is not intended to be limited to any particular form or embodiment, except insofar as such limitations are expressly set forth in the claims.

I claim:

1. A cut sheet handling system comprising a pair of sheet feeding tapes guided for movement in a closed path, means for guiding the tapes in converging paths to receive the cut sheets seriatim and then guiding the tapes in side-by-side relation along a sheet feeding span and then guiding the tapes in diverging paths to release the sheets, a guide having a tapered upstream end interposed between the diverging paths of the sheet feeding tapes, a pair of concave diverging sheet guiding surfaces on the guide extending in diverging paths from the tapered upstream end thereof, rotary guide rolls having their outer convex surfaces adjacent and spaced apart from each of the guiding surfaces to guide each of the tapes in closely spaced apart relation to the guiding surfaces to define a sheet feeding channel therebetween, rotary diverters mounted coaxially with the tape guiding rollers and having raised cam surfaces which cooperate with the more remote tapes to define converging surfaces to guide the leading ends of the sheets past the upstream tapered end of the guide and into the channel defined by the more remote tape and the adjacent guiding surface, the upstream end of the guide and the raised cam surfaces intermeshing to permit the cam surfaces to recess beneath the guiding surfaces after guiding the leading ends of the sheets thereto, thereby releasing the leading end of the sheet within the appropriate channel, the circumferential length of each raised cam surface permitting it and the cooperating more remote tape to guide and support each sheet upstream of the tapered end of the guide through a substantial length of the sheet so that the portion of the sheet upstream of the leading end will not whip or be damaged or be permitted to enter the wrong path.

2. A sheet handling system as set forth in claim 1 in which the cam surfaces of the rotary diverters are of substantially equal circumferential length to support each sheet throughout a substantial length of the sheet and to divert successive sheets in different directions.

3. A sheet handling system as set forth in claim 1 in which at least one of the cam surfaces is of a circumferential length which exceeds the circumferential length of the other cam surface by an amount necessary to divert two successive sheets in the same direction.

4. A sheet handling system as set forth in claim 1 including another sheet feeding tape cooperating with one of said pair of sheet feeding tapes downstream of the guide surface to receive the leading end of a sheet from the guiding surface and advance the sheet.

5. A sheet handling system as set forth in claim 1 including a sheet collector to which similar sheets are fed in a stream, a pair of sheet feeding tapes which are guided for movement in side-by-side relation and then are guided for movement in diverging paths to release the sheets and a pair of slow-down rolls which reduce the speed of travel of the sheets fed toward the sheet collection.

* * * * *